US009963655B2

(12) United States Patent
Woodward et al.

(10) Patent No.: US 9,963,655 B2
(45) **Date of Patent: *May 8, 2018**

(54) LUBRICATING OIL COMPOSITIONS

(75) Inventors: Philip J. Woodward, Reading (GB); Wangkan Lin, Bridgewater, NJ (US); Erika M. Vela, Westfield, NJ (US)

(73) Assignee: INFINEUM INTERNATIONAL LIMITED (GB)

( * ) Notice: Subject to any disclaimer, the term of this patent is extended or adjusted under 35 U.S.C. 154(b) by 0 days. days.

This patent is subject to a terminal disclaimer.

(21) Appl. No.: 13/445,349

(22) Filed: Apr. 12, 2012

(65) Prior Publication Data

US 2013/0274161 A1 Oct. 17, 2013

(51) Int. Cl.
*C10M 169/04* (2006.01)
*C10M 129/02* (2006.01)
*C10M 161/00* (2006.01)

(52) U.S. Cl.
CPC ..... *C10M 129/02* (2013.01); *C10M 161/00* (2013.01); *C10M 2203/1006* (2013.01); *C10M 2205/0285* (2013.01); *C10M 2207/022* (2013.01); *C10M 2207/129* (2013.01); *C10M 2207/289* (2013.01); *C10M 2209/10* (2013.01); *C10M 2209/104* (2013.01); *C10M 2209/105* (2013.01); *C10M 2209/106* (2013.01); *C10M 2209/109* (2013.01); *C10M 2215/042* (2013.01); *C10M 2219/046* (2013.01); *C10M 2219/068* (2013.01); *C10M 2223/045* (2013.01); *C10M 2229/02* (2013.01); *C10N 2210/02* (2013.01); *C10N 2210/06* (2013.01); *C10N 2230/06* (2013.01); *C10N 2230/40* (2013.01); *C10N 2230/43* (2013.01); *C10N 2230/45* (2013.01); *C10N 2230/70* (2013.01); *C10N 2240/10* (2013.01)

(58) Field of Classification Search
CPC ..... C10M 2207/129; C10N 2230/02
USPC ..... 508/306, 591
See application file for complete search history.

(56) References Cited

U.S. PATENT DOCUMENTS

2006/0068999 A1* 3/2006 Shaw et al. ..... 508/287

FOREIGN PATENT DOCUMENTS

WO WO-2011107739 A1 9/2011

* cited by examiner

*Primary Examiner* — Vishal Vasisth

(57) ABSTRACT

An additive package for an internal combustion engine crankcase lubricating oil composition, which additive package comprises or is made by admixing:

(A) 5-99.4 mass % based on the mass of the additive package, of a diluent oil of lubricating viscosity; and (B) the following additives:

(B1) 0.1-10 mass % of a polymeric friction modifier, on an active matter basis, based on the mass of the additive package, which polymeric friction modifier is the reaction product of (a) a functionalised polyolefin, (b) a polyether, (c) a polyol, and (d) a monocarboxylic acid chain terminating group (B2) 0.5 to 10 mass % on an active matter basis, based on the mass of the additive package of one or more ashless organic friction modifiers that include a polar terminal group covalently bonded to a monomeric oleophilic hydrocarbon chain.

7 Claims, No Drawings

LUBRICATING OIL COMPOSITIONS

This invention relates to internal combustion engine crankcase additive packages and lubricating oil compositions containing them. In particular, this invention relates to internal combustion engine crankcase additive packages with improved additive stability.

BACKGROUND OF THE INVENTION

Lubricating oil compositions for internal combustion engines commonly comprise various combinations of chemical additives designed to impart improved performance characteristics to the lubricant and thereby the engine. The additives are commonly prepared as an additive package comprising a specific combination of additives for a particular application, which are mixed together with diluent oil. The diluent oil facilitates storage and use. To prepare a fully formulated oil, the additive package is mixed with the required base oil (s) and any additional additives.

An additive package can be stored on the shelf for some time between manufacture and use. Given that the additives comprise a variety of different chemicals, it is not unusual for some of the additives to interact with each other. Whilst the chemicals do not necessarily chemically react with one another, some of them do not mix well together. This can result in undesirable generation of haze or sediment in the additive package.

Additive package stability is a key concern to additive package formulators. Interaction of additives can limit the combinations of additives that the formulator can use and means that sometimes an additive combination that is desirable for lubricant performance benefits cannot be used due to additive package instability.

It has long been known to use friction modifiers and combinations of friction modifiers to obtain improved performance including improved wear performance and improved fuel economy. However, conventional friction modifiers often cause additive package instability as a result of poor compatibility of the friction modifiers with other additives present in an additive package. This effect becomes increasingly apparent as the amount of these conventional friction modifiers increases in the additive package. With the current drive to reduce friction coefficients of lubricants in order to improve fuel economy, it is desirable to use higher treat rates of friction modifier. However, this is not generally possible as it results in unacceptable levels of additive package instability.

In an attempt to address this problem, the present inventors have been looking for novel friction modifier compositions.

A recent example of a friction reducing additive for use in automotive engine oil and/or fuel is described in International patent application No. WO 2011/107739. The friction reducing additives described in this document are the reaction product of a hydrophobic polymeric subunit selected from polyolefins, polyacrylics and polystyrenyls and a hydrophilic polymeric sub unit selected from polyethers, polyesters and polyamides. The friction reducing additives described in WO 2011/107739 are said to facilitate improved fuel economy and fuel economy retention performance in an engine oil or fuel.

SUMMARY OF THE INVENTION

In a first aspect, this invention provides an additive package for an internal combustion engine crankcase lubricating oil composition, which additive package comprises or is made by admixing:

(A) a diluent oil of lubricating viscosity; and
(B) the following additives:
(B1) a polymeric friction modifier, which polymeric friction modifier is the reaction product of
  (a) a functionalised polyolefin,
  (b) a polyether,
  (c) a polyol, and
  (d) a monocarboxylic acid chain terminating group;
(B2) an ashless organic friction modifier, comprising one or more ashless monomeric friction modifiers that include a polar terminal group covalently bonded to a monomeric oleophilic hydrocarbon chain.

In a second aspect, the present invention provides a lubricating oil composition comprising 80-95 mass % of a base stock and 5-20 mass % of an additive package according to the first aspect of the present invention, based on the mass of the lubricating oil composition.

In a third aspect, the present invention provides a method of improving the stability of additive packages containing high levels of friction modifying components, which method comprises forming an additive package using a combination of friction modifying additives according to the first aspect of the present invention.

In a fourth aspect, the present invention provides an additive package, as in the first aspect that displays improved package stability that, when used to form an internal combustion engine crankcase lubricating oil composition, as in the second aspect, provides minimized antiwear performance debits.

In this specification, the following words and expressions, if and when used, shall have the meanings ascribed below:

"active ingredient" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means in excess of 50 mass % of a composition;

"minor amount" means less than 50 mass % of a composition;

"TBN" means total base number as measured by ASTM D2896.

Furthermore in this specification:

"phosphorus content" is as measured by ASTM D5185;

"sulphated ash content" is as measured by ASTM D874;

"sulphur content" is as measured by ASTM D2622;

"$KV_{100}$" means kinematic viscosity at 100° C. as measured by ASTM D445.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention relating, where appropriate, to each and all aspects of the invention, are described in more detail as follows:

Diluent Oil (A)

The diluent oil of the first aspect of the present invention and the base stock of the second aspect of the invention (sometimes referred to as "base oil") may be selected from natural (vegetable, animal or mineral) and synthetic lubricating oils and mixtures thereof.

The base stock groups are defined in the American Petroleum Institute (API) publication "Engine Oil Licensing and Certification System", Industry Services Department, Fourteenth Edition, December 1996, Addendum 1, December 1998.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in Table E-1.
b) Group II base stocks contain greater than or equal to 90 percent saturates and less than or equal to 0.03 percent sulphur and have a viscosity index greater than or equal to 80 and less than 120 using the test methods specified in Table E-1.
c) Group III base stocks contain greater than or equal to 90 percent saturates and less than or equal to 0.03 percent sulphur and have a viscosity index greater than or equal to 120 using the test methods specified in Table E-1.
d) Group IV base stocks are polyalphaolefins (PAO).
e) Group V base stocks include all other base stocks not included in Group I, II, III, or IV.

TABLE E-1

Analytical Methods for Base Stock

| Property | Test Method |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

In addition additives included in the additive package may comprise a carrier oil, which carrier oil is not considered part of the diluent oil of the first aspect of the present invention or the base oil of the second aspect of the present invention for calculating the composition of the additive package or lubricant respectively.

Examples of oils of lubricating viscosity which may be used as the diluent oil or the base stock for a lubricating oil composition containing the additive package of the present invention are detailed as follows.

Natural oils include animal and vegetable oils (e.g. castor and lard oil), liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Other examples of base oil are gas-to-liquid ("GTL") base oils, i.e. the base oil may be an oil derived from Fischer-Tropsch synthesised hydrocarbons made from synthesis gas containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

Preferably, the volatility of the oil of lubricating viscosity, as measured by the Noack test (ASTM D5880), is less than or equal to 20%, preferably less than or equal to 16%, preferably less than or equal to 12%, more preferably less than or equal to 10%.

The terms "oil-soluble" or "dispersible", or cognate terms, used herein do not necessarily indicate that the compounds or additives are soluble, dissolvable, miscible, or are capable or being suspended in the oil in all proportions. They do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

Polymeric Friction Modifiers (B1)

As with all polymers, the polymeric friction modifier of the present invention will comprise a mixture of molecules of various sizes. Suitably, the majority of the molecules have a molecular weight in the range of 1,000 to 30,000 Daltons.

The functionalised polyolefin is preferably derived from a polymer of a monoolefin having from 2 to 6 carbon atoms, such as ethylene, propylene, butane and isobutene. The functionalised polyolefin of the present invention suitably contains a chain of from 15 to 500, preferably 50 to 200 carbon atoms. Preferably, the polymer of the first polymeric sub unit is polyisobutene or a derivative thereof.

The functionalised polyolefin may comprise a diacid or anhydride functional group from reaction of the polyolefin with an unsaturated diacid or anhydride. The functionalised polyolefin is suitably functionalised by reaction with, for example, maleic anhydride.

In a preferred embodiment, the functionalised polyolefin is a polyisobutylene polymer that has been reacted with maleic anhydride to form polyisobutylene succinic anhydride (PIBSA). Suitably, the PIBSA has a molecular weight in the range of 300-5000 Da, preferably 500-1500 Da and especially 800 to 1200 Da. PIBSA is a commercially available compound made from the addition reaction of polyisobutylene having a terminal unsaturated group and maleic anhydride.

Alternatively, the functionalised polyolefin may be functionalised by an epoxidation reaction with a peracid, for example perbenzoic acid or peracetic acid.

The polyether may comprise, for example, polyglycerol or polyalkylene glycol. In a preferred embodiment the polyether is a water soluble alkylene glycol, such as polyethylene glycol (PEG). Suitably the PEG has a molecular weight in the range of 300-5000 Da, more preferably 400-1000 Da and particularly 400 to 800 Da. In a preferred embodiment the polyether is $PEG_{400}$, $PEG_{600}$ or $PEG_{1000}$. Alternatively, a mixed poly(ethylene-propylene) glycol or a mixed poly(ethylene-butylene) glycol may be used. Alternatively, the polyether may be derived from a dial or a diamine containing acidic groups, for example, carboxylic acid groups, sulphonyl groups (e.g. sulphonyl styrenic groups), amine groups (e.g. tetraethylene pentamine or polyethylene imine) or hydroxyl groups.

The polyether suitably has a molecular weight of 300-5,000 Da, more preferably 400-1,000 Da or 400-800 Da.

The functionalised polyolefin and the polyether of the present invention may form block copolymer units.

The functionalised polyolefin and the polyether may be linked directly to one another and/or they may be linked together by a backbone moiety.

The polyol reactant of the polymeric friction modifier of the present invention suitably provides a backbone moiety capable of linking together the functionalised polyolefin and polyether reactants. The polyol may be a diol, triol, tetrol, and/or related dimers or trimers or chain extended polymers of such compounds. Suitable polyols include glycerol, neopentyl glycol, trimethylolethane, trimethylolpropane, trimethylolbutane, pentaerythritol, dipentaerythritol, tripentaerythritol and sorbitol. In a preferred embodiment the polymeric friction modifier comprises a glycerol backbone moiety.

The polymeric friction modifier of the present invention comprises monocarboxylic acid chain terminating group. Any carboxylic acid would be a suitable chain terminating group. Suitable examples include $C_{2-36}$ carboxylic acids, preferably $C_{6-30}$ carboxylic acids and more preferably, $C_{12-22}$ carboxylicacids. The carboxylic acids may be linear saturated, branched saturated, linear unsaturated and branched unsaturated acids. In preferred embodiments the carboxylic acid chain terminating group is chosen from the group comprising lauric acid, erucic acid, isostearic acid, palmitic acid, oleic acid and linoleic acid. In an embodiment the carboxylic acid chain terminating group is fatty carboxylic acid.

The polymeric friction modifier (B1) suitably has an average molecular weight of from 1,000 to 30,000 Da, preferably from 1,500 to 25,000, more preferably from 2,000 to 20,000 Da.

The polymeric friction modifier (B1) suitably has an acid value of less than 20, preferably less than 15 and more preferably less than 10. The polymeric friction modifier (B1) suitably has an acid value of greater than 1, preferably greater than 3 and more preferably greater than 5. In a preferred embodiment, the polymeric friction modifier (B1) has an acid value in the range of 6 to 9.

Suitably, the polymeric friction modifer (B 1) is as described in International Patent Application no WO 2011/107739, and the description and examples of the method of making the friction modifier therein is incorporated herein by reference thereto.

An example of polymeric friction modifier (B1) is a reaction product of maleinised polyisobutylene, PEG, glycerol and tall oil fatty acid, wherein the polyisobutylene of the maleinised polyisobutylene has an average molecular weight of around 950 amu, and an approximate saponification value of % mg KOH/g and the PEG has a hydroxyl value of 190 mgKOH/g. A suitable additive may be made by charging 110 g of maleinised polyisobutylene, 72 g of PEG, 5 g of glycerol and 25 g of tall oil fatty acid into a glass round bottomed flask equipped with a mechanical stirrer, isomantle heater and overhead condenser. The reaction takes place in the presence of 0.1 g of esterification catalyst terabutyl titanate at 200-220° C., with removal of water to a final acid value of 10 mg KOH/g.

The polymeric friction modifier of the present invention is suitably present in the additive package, on an active matter basis, in an amount of at least 0.1, preferably at least 0.5 mass % and more preferably at least 1 mass %, based on the mass of the additive package. The polymeric friction modifier of the present invention is suitably present in the additive package, on an active matter basis, in an amount of less than 10 mass %, preferably less than 6 mass %, based on the mass of the additive package.

The polymeric friction modifier of the present invention is suitably present in the additive package in an amount sufficient to provide a lubricating oil composition made from the additive package, on an active matter basis, with at least 0.1, preferably at least 0.3 mass % thereof, based on the mass of the lubricating oil composition. The polymeric friction modifier of the present invention is suitably present in the additive package in an amount sufficient to provide a lubricating oil composition made from the additive package, on an active matter basis, with less than mass %, preferably less than 1 mass % thereof, based on the mass of the lubricating oil composition.

Ashless Organic Friction Modifier (B2)

The ashless (metal-free) organic friction modifier of the present invention may be any conventional ashless organic lubricating oil friction modifier. Examples of suitable ashless organic friction modifiers include monomeric friction modifiers that include a polar terminal group (e.g. carboxyl or hydroxyl or aminic) covalently bonded to a monomeric oleophilic hydrocarbon chain. The monomeric olephilic hydrocarbon chain suitably comprises 12 to 36 carbon atoms. Suitably, the monomeric olephilic hydrocarbon chain is predominantly linear, for example at least 90% linear. The monomeric olephilic hydrocarbon chain is suitably derived from an animal or vegetable fat. The ashless organic friction modifier (B2) may comprise a mixture of ashless organic friction modifiers.

Suitable ashless nitrogen-free organic friction modifiers include esters formed by reacting carboxylic acids and anhydrides with alkanols. Esters of carboxylic acids and anhydrides with alkanols are described in U.S. Pat. No. 4,702,850. Preferred ashless organic nitrogen-free friction modifiers are esters or ester-based; a particularly preferred organic ashless nitrogen-free friction modifier is glycerol monooleate (GMO).

Ashless aminic or amine-based friction modifiers may also be used and include oil-soluble alkoxylated mono- and di-amines. One common class of such ashless nitrogen-containing friction modifier comprises ethoxylated alkyl amines. Such friction modifiers may also be in the form of an adduct or reaction product with a boron compound such as a boric oxide, boron halide, metaborate, boric acid or a mono-, di- or tri-alkyl borate.

Another ashless aminic friction modifier is an ester formed as the reaction product of (i) a tertiary amine of the formula $R_1R_2R_3N$ wherein $R_1$, $R_2$ and $R_3$ represent aliphatic hydrocarbyl, preferably alkyl, groups having 1 to 6 carbon atoms, at least one of $R_1$, $R_2$ and $R_3$ having a hydroxyl group, with (ii) a saturated or unsaturated fatty acid having 10 to 30 carbon atoms. Preferably, at least one of $R_1$, $R_2$ and $R_3$ is an alkyl group. Preferably, the tertiary amine will have at least one hydroxyalkyl group having 2 to 4 carbon atoms. The ester may be a mono-, di- or tri-ester or a mixture thereof, depending on how many hydroxyl groups are available for esterification with the acyl group of the fatty acid. A preferred embodiment comprises a mixture of esters formed as the reaction product of (i) a tertiary hydroxy amine of the formula $R_1R_2R_3N$ wherein $R_1$, $R_2$ and $R_3$ may be a $C_2$-$C_4$ hydroxy alkyl group with (ii) a saturated or unsaturated fatty acid having 10 to 30 carbon atoms, with a mixture of esters so formed comprising at least 30-60 wt. %, preferably 45-55 wt. % diester, such as 50 wt. % diester, 10-40 wt. %, preferably 20-30 wt. % monoester, e.g. 25 wt. % monoester, and 10-40 wt. %, preferably 20-70 wt. % triester, such as 25 wt. % triester. Suitably, the ester is a mono-, di- or tri-carboxylic acid ester of triethanolamine and mixtures thereof.

Examples of other conventional organic friction modifiers are described by M. Belzer in the "Journal of Tribology" (1992), Vol. 114, pp. 675-682 and M. Belzer and S. Jahanmir in "Lubrication Science" (1988), Vol. 1, pp. 3-26.

The ashless organic friction modifier of the present invention is suitably present in the additive package, on an active matter basis, in an amount of at least 0.5, preferably at least 1.0 mass % and more preferably at least 1.5 mass %, based on the mass of the additive package. The ashless organic friction modifier of the present invention is suitably present in the additive package, on an active matter basis, in an amount of less than 10 mass %, preferably less than 6 mass %, based on the mass of the additive package.

The ashless organic friction modifier of the present invention is suitably present in the additive package in an amount sufficient to provide a lubricating oil composition made from the additive package, on an active matter basis, with at least 0.05, such as at least 0.1, preferably at least 0.2 mass % thereof, based on the mass of the lubricating oil composition. The ashless organic friction modifier of the present invention is suitably present in the additive package in an amount sufficient to provide a lubricating oil composition made from the additive package, on an active matter basis, with less than 5 mass %, preferably less than 1 mass % thereof, based on the mass of the lubricating oil composition.

Other Additives

Other additives, such as the following, may also optionally be present in the additive package of the present invention or in lubricating oil compositions comprising the additive package of the present invention.

An additive package according to the present invention may further comprise one of more additives chosen from the group comprising metal-containing detergents, ashless detergents, antiwear agents, ashless dispersants, oil-soluble molybdenum compounds, anitoxidants and silicon antifoamants.

Metal detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as can be measured by ASTM D2896) of from 0 to 80. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents may have a TBN of 150 or greater, and typically will have a TBN of from 250 to 450 or more. In the presence of the compounds of Formula I, the amount of overbased detergent can be reduced, or detergents having reduced levels of overbasing (e.g., detergents having a TBN of 100 to 200), or neutral detergents can be employed, resulting in a corresponding reduction in the SASH content of the lubricating oil composition without a reduction in the performance thereof.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Combinations of detergents, whether overbased or neutral or both, may be used.

In one embodiment of the present invention, the additive package includes metal detergents that are chosen from neutral or overbased calcium sulfonates having TBN of from 20 to 450 TBN, and neutral and overbased calcium phenates and sulfurized phenates having TBN of from 50 to 450, and mixtures thereof.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 mass % (preferably at least 125 mass %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

In another embodiment of the present invention, the additive package comprises metal detergents that are neutral or overbased alkali or alkaline earth metal salicylates having a TBN of from 50 to 450, preferably a TBN of 50 to 250, or mixtures thereof. Highly preferred salicylate detergents include alkaline earth metal salicylates, particularly magnesium and calcium, especially, calcium salicylates. In one embodiment of the present invention, alkali or alkaline earth metal salicylate detergents are the sole metal-containing detergent in the lubricating oil composition.

Anti-wear agents reduce friction and excessive wear and are usually based on compounds containing sulfur or phosphorous or both, for example that are capable of depositing polysulfide films on the surfaces involved. Noteworthy are dihydrocarbyl dithiophosphate metal salts wherein the metal may be an alkali or alkaline earth metal, or aluminium, lead, tin, molybdenum, manganese, nickel, copper, or preferably, zinc. Dihydrocarbyl dithiophosphate metal salts may be prepared in accordance with known techniques by first forming a dihydrocarbyl dithiophosphoric acid (DDPA), usually by reaction of one or more alcohols or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are most generally employed. Commercial additives frequently contain an excess of metal due to the use of an excess of the basic metal compound in the neutralization reaction.

The preferred zinc dihydrocarbyl dithiophosphates (ZDDP) are oil-soluble salts of dihydrocarbyl dithiophosphoric acids and may be represented by the following formula:

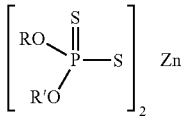

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R'groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates.

The ZDDP is suitably added to the additive package in amounts sufficient to provide a lubricating oil composition comprising the additive package with no greater than 1200 ppm, preferably no greater than 1000 ppm and more preferably, no greater than 900 ppm phosphorous to the lubricating oil, based upon the total mass of the lubricating oil composition. In a preferred embodiment, the ZDDP is added to the additive package in amounts sufficient to provide a lubricating oil composition comprising the additive package with no greater than 800 ppm, preferably no greater than 600 ppm phosphorous to the lubricating oil, based upon the total mass of the lubricating oil composition. The ZDDP is suitably added to the additive package in amounts sufficient to provide a lubricating oil composition comprising the additive package with at least 100 ppm, preferably at least 350 ppm and more preferably, at least 500 ppm phosphorous to the lubricating oil, based upon the total mass of the lubricating oil composition.

Examples of other ashless anti-wear agents include 1,2,3-triazoles, benzotriazoles, sulfurised fatty acid esters, and dithiocarbamate derivatives.

Ashless dispersants comprise an oil-soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersants may be, for example, selected from oil-soluble salts, esters, aminoesters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and a polyalkylene polyamine.

Oil soluble molybdenum compounds include any suitable oil-soluble organo-molybdenum compound. As examples of suitable oil-soluble organo-molybdenum compounds, there may be mentioned dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Suitable molybdenum compounds include mono-, di-, tri- or tetra-nuclear. Dinuclear and trinuclear molybdenum compounds are preferred, especially preferred are trinuclear molybdenum compounds. Suitable molybdenum compounds are preferably organo-molybdenum compound. More preferably, any molybdenum compound is selected from the group consisting of molybdenum dithiocarbamates (MoDTC), molybdenum dithiophosphates, molybdenum dithiophosphinates, molybdenum xanthates, molybdenum thioxanthates, molybdenum sulfides and mixtures thereof. Most preferably, any molybdenum compound is present as a molybdenum dithiocarbamate compound.

Additionally, a molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions of the present invention can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897.

Among the molybdenum compounds useful in the compositions of this invention are organo-molybdenum compounds of the formulae $Mo(ROCS_2)_4$ and $Mo(RSCS_2)_4$, wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

One class of preferred organo-molybdenum compounds useful in the lubricating compositions of this invention are trinuclear molybdenum compounds, especially those of the formula $Mo_3S_kL_nQ_z$ and mixtures thereof wherein L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

If the additive package of the present invention comprises a molybdenum additive, the additive package may contain a molybdenum compound in an amount providing a lubricating oil composition containing the additive package with at least 10 ppm, preferably at least 20 ppm and more preferably at least 40 ppm or molybdenum, based on atoms of molybdenum, in the total mass of the lubricating oil composition. A lubricating oil composition comprising an additive package according to the present invention may contain a molybdenum compound in an amount providing the composition with no more than 1000 ppm, preferably no more than 700 ppm and more preferably no more than 500 ppm of molybdenum, based on atoms of molybdenum, in the total mass of the lubricating oil composition.

Viscosity modifiers (VM) function to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Anti-oxidants are sometimes referred to as oxidation inhibitors; they increase the resistance of the composition to oxidation and may work by combining with and modifying peroxides to render them harmless, by decomposing peroxides, or by rendering an oxidation catalyst inert. Oxidative deterioration can be evidenced by sludge in the lubricant, varnish-like deposits on the metal surfaces, and by viscosity growth.

Examples of suitable antioxidants are selected from copper-containing antioxidants, sulfur-containing antioxidants, aromatic amine-containing antioxidants, hindered phenolic antioxidants, dithiophosphates derivatives, and metal thiocarbamates. Preferred anti-oxidants are aromatic amine-containing antioxidants, hindered phenolic antioxidants and mixtures thereof. In a preferred embodiment, an antioxidant is present in an additive package according to the present invention.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK Patent Specification No. 1,560,830. Benzotriazoles derivatives also fall within this class of additives. When these compounds are included in the additive package, they are preferably present in an amount providing not more than 0.2 wt. % active ingredient to a lubricating oil comprising the additive package.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient in the lubricating oil composition comprising the additive package. A treat rate in the fully formulated lubricant of 0.001 to 0.05 mass %, active ingredient, is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

The individual additives may be incorporated into the diluent oil in any convenient way.

Preferably, all the additives except for the viscosity modifier and the pour point depressant are blended into the additive package, and that additive package is subsequently blended into base stock to make a finished lubricant. The additive package concentrate will typically be formulated to contain the additive(s) in proper amounts to provide the desired concentration in a fully formulated lubricant when the concentrate is combined with a predetermined amount of a base oil.

The concentrate may be made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formulation of the second aspect of the present invention may employ from 2 to 20, preferably 4 to 18, and most preferably 5 to 17, mass % of the additive package of the first aspect of the invention with the remainder being base stock and optionally viscosity modifier and pour point depressant.

Typically, an additive package according to the first aspect of the present invention suitably contains up to 4, more preferably up to 3, most preferably up to 2, mass % sulfur, based on the total mass of the composition and as measured according to ASTM method D4927. In an embodiment of the present invention, the additive package does not comprise 1.5-1.6 mass % of sulphur as measured according to ASTM method D4927.

Typically, a lubricating oil composition according to the second aspect of the present invention suitably contains up to 0.4, more preferably up to 0.3, most preferably up to 0.2, mass % sulfur, based on the total mass of the composition and as measured according to ASTM method D4927. In an embodiment of the present invention, a lubricating oil composition according to the second aspect of the invention does not comprise 0.2-0.25 mass % of sulphur as measured according to ASTM method D4927.

An additive package according to the first aspect of the present invention suitably contains up to and including 12 mass %, preferably up to 10 mass %, even more preferably up to 9 mass % sulphated ash.

A lubricating oil composition according to the second aspect of the present invention suitably contains up to and including 1.2 mass %, preferably up to 1.1 mass %, even more preferably up to 1.0 mass % sulphated ash.

Typically, an additive package according to the first aspect of the present invention suitably contains up to 2.0 more preferably up to 1.5, most preferably up to 1.0, mass % nitrogen, based on the total mass of the composition and as measured according to ASTM method D5291. In an embodiment of the present invention, the additive package does not comprise between 0.60 and 0.74 mass % of nitrogen as measured according to ASTM method D5291.

Typically, a lubricating oil composition according to the second aspect of the present invention suitably contains up to 0.30, more preferably up to 0.20, most preferably up to 0.15, mass % nitrogen, based on the total mass of the composition and as measured according to ASTM method D5291. In an embodiment of the present invention, a lubricating oil composition according to the second aspect of the invention does not comprise 0.08-0.11 mass % of nitrogen as measured according to ASTM method D5291.

Typically, an additive package according to the first aspect of the present invention has a total base number (TBN) as measured by ASTM D2896 of 25 to 100, preferably 45 to 80. In an embodiment of the present invention, the additive package does not have a total base number (TBN) as measured by ASTM D2896 of between 62 and 63.5. Typically, a lubricating oil composition according to the second aspect of the present invention has a total base number (TBN) as measured by ASTM D2896 of 4 to 15, preferably 5 to 12. In an embodiment of the present invention, the lubricating oil composition does not have a total base number (TBN) as measured by ASTM D2896 of between 9.05 and 9.27.

Preferably, the lubricating oil composition according to the second aspect of the invention is a multigrade identified by the viscometric descriptor SAE 20WX, SAE 15WX, SAE 10WX, SAE 5WX or SAE 0WX, where X represents any one of 20, 30, 40 and 50; the characteristics of the different viscometric grades can be found in the SAE J300 classification. In an embodiment of each aspect of the invention, independently of the other embodiments, the lubricating oil composition is in the form of an SAE 10WX, SAE 5WX or SAE 0WX, preferably in the form of an SAE 5WX or SAE 0WX, wherein X represents any one of 20, 30, 40 and 50. Preferably X is 20 or 30.

EXAMPLE

The invention will now be described in the following examples which are not intended to limit the scope of the claims hereof.

Additive Package Stability

Seven additive package samples were prepared according to Table 1. Each of the additive package samples 1 to 7 comprised a base additive package, which contained ashless dispersant, ZDDP, antioxidants, molydenum dithiocarbamate, calcium sulphonate detergent, polyisobutenylsuccinic anhydride, silicon antifoamant comprising 11.6 mass % of Group I diluent oil. The additive packages 1 to 7 each comprises 95 grams of base additive package and then various amounts of friction modifier as set out in Table 1. The friction modifiers included a polymeric friction modifier made according to the process set out on page 10 above, as component (B 1) and glycerol monooleate (GMO) and/or an ethoxylated tallow amine (ETA) as representative examples of component (B2). The base additive package and additive packages 1 to 7 were subject to the following storage stability test and the results are set out in Table 2.

Storage Stability Test Method 100 ml of the sample to be tested is poured into a centrifuge tube and the tube is supported near-vertically in an oven at 60° C. The condition of all samples was observed and noted initially and at weekly intervals for 10 weeks. The centrifuge tube was observed under both natural light and a high intensity light source for sediment. The outside of the centrifuge tube was cleaned with solvent, if required, to ensure a clear view. Sediment is hard, solid particles which have collected at the very bottom of the tube. Often there is some light sediment or emulsion with a distinguishable top surface of interface just above the hard sediment. This is referred to as the "Haze Layer (cuff). The % volume of sediment and % volume of light sediment or emulsion, if present, was recorded. During the weekly inspection of the samples, if the sample showed sediment volume over 0.05 mass %, the sample was deemed to have failed at that point and the amount of sediment volume and the week were recorded as the final result. If there was no sediment by the end of week 10, the result was recorded as 0/10.

It can be seen from the results in Table 2 that additive packages 4 to 7, comprising only conventional ashless organic friction modifiers, fail the stability test. Even at treat rates as low as 4 grams of GMO, this conventional ashless organic friction modifier fails the stability test. However, when part of the conventional ashless friction modifier is replaced by polymeric friction modifier, the additive package stability improved significantly, see examples 2 and 3.

Thus, a combination of conventional ashless organic friction modifier and the polymeric friction modifier of the present invention enables higher treat rates of friction modifier to be used than would otherwise be possible with just conventional ashless organic friction modifier.

Antiwear Performance

Two oil compositions were prepared, each containing only friction modifier and oil. A high frequency reciprocating rig (ex PCS Instruments) was used to evaluate the antiwear properities of each of the above oil compositions as well as that of a control oil with no friction modifier by measuring the HFRR disc wear scar volume in $\mu m^3$ via optical profilometry. Experimentation was carried out under the following conditions:

| | |
|---|---|
| Contact | 6 mm Ball on 10 mm Disc |
| Load | 4 |
| Stroke Length, Mm | 1 |
| Frequency, Hz | 40 |
| Stage Temp., ° C. | 40-140 (20° C. steps, 6 stages) |
| Rub Time Per Stage, Min. | 5 |

The results are shown in Table 3; a smaller wear scar volume can be equated with less wear. As shown, oil 9 containing the polymeric friction modifier as the sole ashless friction modifier resulted in an improvement in wear performance relative to the control sample. Oil 10 shows that a combination of GMO and the polymeric friction modifier exhibited an increased improvement in wear performance compared to the control.

Thus is can be seen that using a combination of polymeric friction modifier and ashless organic friction modifier according to the present invention, can provide a balance between improving wear performance and improving additive package stability. Use of the polymeric friction modifier in combination with ashless organic friction modifiers provides improved wear performance whilst simultaneously imparting improved additive package stability.

TABLE 1

| Component grams | 1 | 2 | 3 | 4 | 5 | 6 | 7 |
|---|---|---|---|---|---|---|---|
| Base Additive package | 95 | 95 | 95 | 95 | 95 | 95 | 95 |
| B1[1] | 5 | 5 | 5 | | | | |
| B2 GMO | | 3 | | 8 | | 4 | 4 |
| B2 ETA | | | 3 | | 8 | 4 | |

[1]B1 was a polymeric friction modifier as described in WO2011/107739

TABLE 2

| Component grams | Base Additive Package | 1 | 2 | 3 | 4 | 5 | 6 | 7 |
|---|---|---|---|---|---|---|---|---|
| B1[1] | | 5 | 5 | 5 | | | | |
| B2 GMO | | | 3 | | 8 | | 4 | 4 |
| B2 ETA | | | | 3 | | 8 | 4 | |
| % sedimentation/no. weeks | 0/10 | 0/10 | 0/10 | 0.05/10 | 1.0/2 | 0.50/4 | 0.25/2 | 1.5/3 |
| Pass/fail | Pass | Pass | Pass | Pass | Fail | Fail | Fail | Fail |

[1]B1 was a polymeric friction modifier as described in WO2011/107739

TABLE 3

| Ex. No. | Component, grams | Av. Wear Scar, Volume/$\mu m^3$ |
|---|---|---|
| 8—Control | 100 g SN150 oil | 257050 |
| 9 | 92 g SN150 oil, 0.8 g polymeric friction modifier | 142710 |
| 10 | 92 g SN150 oil, 0.5 g polymeric friction modifier, 0.3 g GMO | 117953 |

What is claimed is:

1. An additive package for an internal combustion engine crankcase lubricating oil composition, which additive package comprises or is made by admixing:

(A) a diluent oil of lubricating viscosity; and (B) the following additives:

(B1) from about 1 to less than 6 mass %, based on the total mass of the additive package, of a polymeric friction modifier, which polymeric friction modifier is the reaction product of (a) polyisobutene functionalized with a diacid or anhydride functional group, (b) polymer of a water soluble alkylene glycol selected from the group consisting of polyethylene glycol, poly(ethylene-propylene) glycol, and poly (ethylene-butylene) glycol, (c) a polyol, and (d) a monocarboxylic acid chain terminating group (B2) from about 1.5 to less than 6 mass %, based on the total mass of the additive package, of an ashless organic friction modifier, comprising one or more monomeric ashless friction modifiers that include a polar terminal carboxyl, hydroxyl or aminic group covalently bonded to a monomeric oleophilic hydrocarbon chain comprising 12 to 36 carbon atoms.

2. An additive package as claimed in claim 1, wherein the polymer of a water soluble alkylerie glycol is polyethylene glycol (PEG) selected from $PEG_{400}$, $PEG_{600}$, $PEG_{1000}$ or mixtures thereof.

3. An additive package as claimed in claim 1, wherein the polyisobutene is functionalised by reaction with maleic anhydride.

4. An additive package as claimed in claim 1, wherein the polyol is glycerol.

5. An additive package as claimed in claim 1, further comprising one of more additives chosen from the group comprising:

(C) metal-containing detements, ashless detergents, antiwear agents, ashless dispersants, oil-soluble molybdenum compounds, antioxidants and silicon aritifoamants.

6. A lubricating oil composition comprising 80-95 mass % of a base stock and 5-20 mass % of an additive package according to claim 1, based on the mass of the lubricating oil composition, wherein said additive package provides said lubricating oil composition with from about 0.3 mass % to about 1 mass % of polymeric friction modifier (B1) and from about 0.2 mass % to about 1 mass % of ashless organic friction modifier (B2).

7. A lubricating oil composition according to claim 6, comprising no more than 1200 ppm phosphorous, no more than 1.0) mass % sulphated ash and no more than 0.4 mass % of sulphur, based on the mass of the lubricating oil composition.

* * * * *